US009512967B2

(12) United States Patent
Lee

(10) Patent No.: US 9,512,967 B2
(45) Date of Patent: Dec. 6, 2016

(54) STRAIGHT TYPE LAMP

(71) Applicant: KUMHO ELECTRIC, INC., Seoul (KR)

(72) Inventor: Nam Goo Lee, Gyeonggi-do (KR)

(73) Assignee: KUMHO ELECTRIC INC., Seoul (KR)

( * ) Notice: Subject to any disclaimer, the term of this patent is extended or adjusted under 35 U.S.C. 154(b) by 286 days.

(21) Appl. No.: 14/192,928

(22) Filed: Feb. 28, 2014

(65) Prior Publication Data

US 2015/0198318 A1 Jul. 16, 2015

(30) Foreign Application Priority Data

Jan. 13, 2014 (KR) ..... 10-2014-0003968

(51) Int. Cl.

| | |
|---|---|
| ***F21V 15/015*** | (2006.01) |
| ***F21K 99/00*** | (2016.01) |
| ***F21V 25/02*** | (2006.01) |
| *F21Y 101/02* | (2006.01) |
| *H01R 13/703* | (2006.01) |
| *H01R 33/06* | (2006.01) |
| *H01R 33/94* | (2006.01) |
| *F21Y 101/00* | (2016.01) |

(52) U.S. Cl.

CPC ..... *F21K 9/175* (2013.01); *F21K 9/27* (2016.08); *F21V 25/02* (2013.01); *F21Y 2101/00* (2013.01); *F21Y 2101/02* (2013.01); *H01R 13/7036* (2013.01); *H01R 33/06* (2013.01); *H01R 33/94* (2013.01)

(58) Field of Classification Search

CPC combination set(s) only.
See application file for complete search history.

(56) References Cited

U.S. PATENT DOCUMENTS

2010/0226131 A1* 9/2010 Higuchi ..... F21S 8/02 362/297
2011/0117786 A1* 5/2011 Takata ..... F21K 9/17 439/628
2015/0364886 A1* 12/2015 Jansen ..... F21V 25/04 362/221

FOREIGN PATENT DOCUMENTS

KR 10-2012-0104908 A 9/2012
KR 10-1295176 B1 8/2013
KR 10-2013-0142904 A 12/2013

OTHER PUBLICATIONS

Korean Office Action dated Jun. 22, 2015.

* cited by examiner

*Primary Examiner* — Anh Mai
*Assistant Examiner* — Fatima Farokhrooz
(74) *Attorney, Agent, or Firm* — Rabin & Berdo, P.C.

(57) ABSTRACT

Disclosed therein is a straight type lamp including: a lamp body; and a pair of sockets fit to both ends of the lamp body. At least one of the sockets includes: a socket housing; a plurality of terminal pins, each of which includes an input terminal protruding to one side of the socket housing and an output terminal arranged inside the socket housing; a push button protruding to one side of the socket housing; and a plurality of elasticity switches, each of which is electrically connected with the terminal pin when the push button moves backwardly and which is electrically disconnected from the terminal pin when the push button returns to its original position.

7 Claims, 4 Drawing Sheets

STRAIGHT TYPE LAMP

BACKGROUND OF THE INVENTION

Field of the Invention

The present invention relates to a straight type LED lamp having an electric shock prevention function.

Background Art

Recently, LED lamps using LEDs (Light Emitting Diodes) as light sources have come into wise use. The LED lamps can remarkably reduce power consumption or carbon dioxide emission and remarkably increase the lifespan of products in comparison with conventional lighting fixtures. Because of such merits of the LED lamps, straight type LED lamps substitute for the conventional fluorescent lamps.

However, straight type lamps have a disadvantage in that users may get shocked when they install the straight type lamps onto fluorescent light fixtures or remove the straight type lamps from the fluorescent light fixtures because the straight type lamps have no electric shock prevention function.

SUMMARY OF THE INVENTION

Accordingly, the present invention has been made to solve the above-mentioned problems occurring in the prior arts, and it is an object of the present invention to provide a straight type lamp having an electric shock prevention function through a simple structure.

To accomplish the above object, according to the present invention, there is provided a straight type lamp including: a lamp body; and a pair of sockets fit to both ends of the lamp body, wherein at least one of the sockets includes: a socket housing; a plurality of terminal pins, each of which includes an input terminal protruding to one side of the socket housing and an output terminal arranged inside the socket housing; a push button protruding to one side of the socket housing; and a plurality of elasticity switches, each of which is electrically connected with the terminal pin when the push button moves backwardly and which is electrically disconnected from the terminal pin when the push button returns to its original position.

Moreover, the straight type lamp further includes a plurality of power connection terminals respectively arranged at the other side of the socket housing and electrically connected with first connection terminals of the elasticity switches.

Furthermore, the output terminal of each of the terminal pins includes an insulating member formed at a position which is in contact with a second connection terminal of the elasticity switch, and the second connection terminal of the elasticity switch moves backwardly to the rear of the insulating member so as to be electrically connected with the output terminal when the push button moves backwardly.

Additionally, the second connection terminal of the elasticity switch is formed in a ring shape and fit to the output terminal.

In addition, the socket housing includes: a first socket housing having a button opening portion from which the push button protrudes; a second socket housing having a plurality of second through holes to which the power connection terminals are inserted; and an internal receiving space formed between the first socket housing and the second socket housing for accommodating the output terminals and the elasticity switches therein.

Moreover, each of the elasticity switches includes: a first connection terminal electrically connected to the power connection terminal; a second connection terminal getting in contact with the output terminal of the terminal pin; an elastic portion formed between the first connection terminal and the second connection terminal for providing elasticity; and an elasticity transferring portion formed between the second connection terminal and the elastic portion, the elasticity transferring portion getting in contact with the push button.

Furthermore, the straight type lamp further includes: a first bolt adapted to electrically connect the first connection terminal of the elasticity switch to one side of the power connection terminal; and a second bolt adapted to electrically connect a wire to the other side of the power connection terminal.

Additionally, the straight type lamp further includes a third bolt penetrating the first socket housing and the second socket housing and being joined to the lamp body, and an end of the third bolt is joined to the lamp body.

In addition, the lamp body includes: a printed circuit board on which a plurality of light emitting elements are arranged; a light transmission member in which the printed circuit board is accommodated; and a power supply part connected with the power connection terminal so as to supply electricity to the light emitting elements.

The straight type lamp according to the preferred embodiment of the present invention can prevent an electric shock of a user when he or she replaces a lamp.

BRIEF DESCRIPTION OF THE DRAWINGS

The above and other objects, features and advantages of the present invention will be apparent from the following detailed description of the preferred embodiment of the present invention in conjunction with the accompanying drawings, in which.

DETAILED DESCRIPTION OF THE PREFERRED EMBODIMENT

Figure 1:
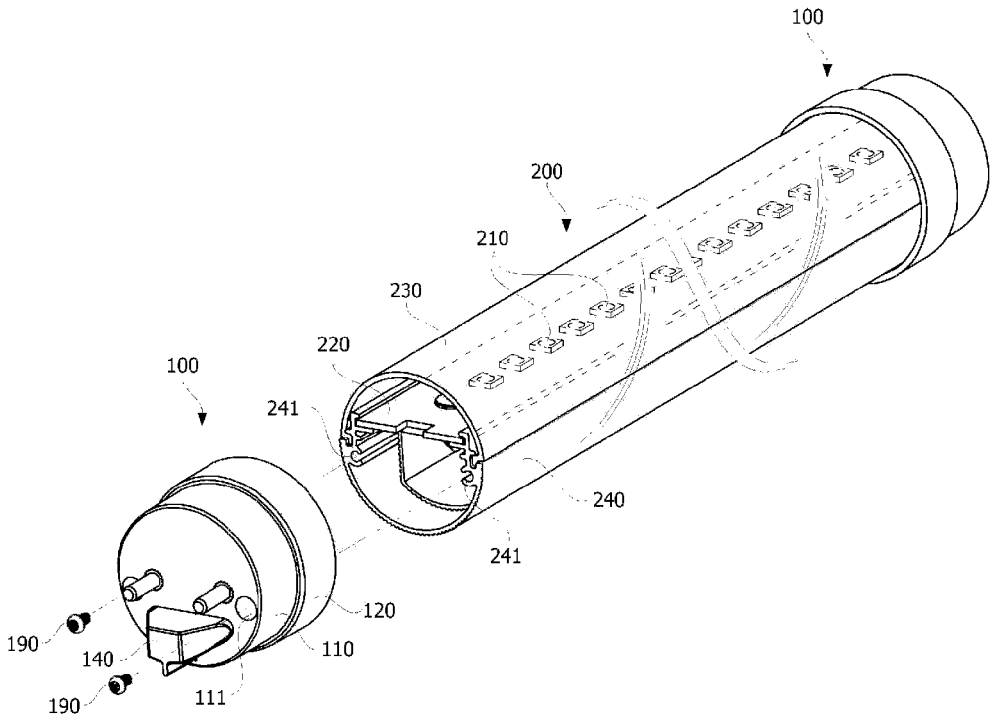
FIG. 1 is a conceptual view of a straight type lamp according to a preferred embodiment of the present invention.

It will be understood by those of ordinary skill in the art that various changes, modifications and alternations may be made in the present invention and that the present invention will be described with reference to the particular illustrative embodiments. However, it will be also understood that the present invention is not limited to the particular embodiments and that all changes, equivalences and alterations without departing from the technical idea and the technical scope of the present invention belong to the present invention.

Terms having ordinal numbers, such as the first, the second, and so on may be used to describe various components, but the components are not restricted to the terms. The terms are used only for the purpose of distinguishing one component from other components. For instance, the second component may be named as the first component without departing from the technical scope of the present invention, and in the same way, the first component may be named as the second component. The term, "and/or", means combination of a plurality of related items or one of a plurality of the related items.

If it is mentioned that a component is "connected" or "linked" to another component, it should be understood that a component may be directly connected or linked to another component, but a further component may exist between the former component and the latter component. On the other hand, if it is mentioned that a component is "directly connected" or "directly linked" to another component, it should be understood that there is no a further component between the former component and the latter component.

Terms used in this specification of the present invention are used for describing particular embodiments and do not limit the present invention. Expressions in singular form contain expressions in plural form unless otherwise specifically contextually stated. It should be understood that terms, "include" or "have", in this specification are just used to inform that there are characteristics, numbers, steps, operations, components or parts, or combinations of them described in this specification and do not exclude one or more other characteristics, numbers, steps, operations, components or parts, or one or more combinations of them, or additional possibility.

Hereinafter, reference will be now made in detail to the preferred embodiments of the present invention with reference to the attached drawings. In description of the preferred embodiments of the present invention, the same components have the same reference numerals even though they are illustrated in different figures.

Figure 2:
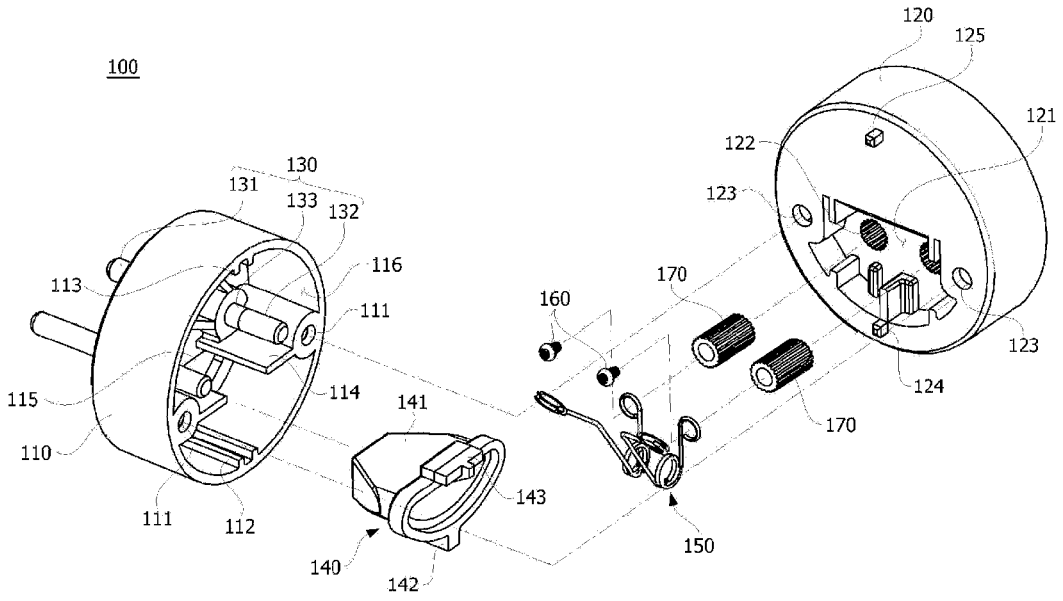
FIG. 2 is an exploded perspective view of a socket according to the preferred embodiment of the present invention.
Figure 3:
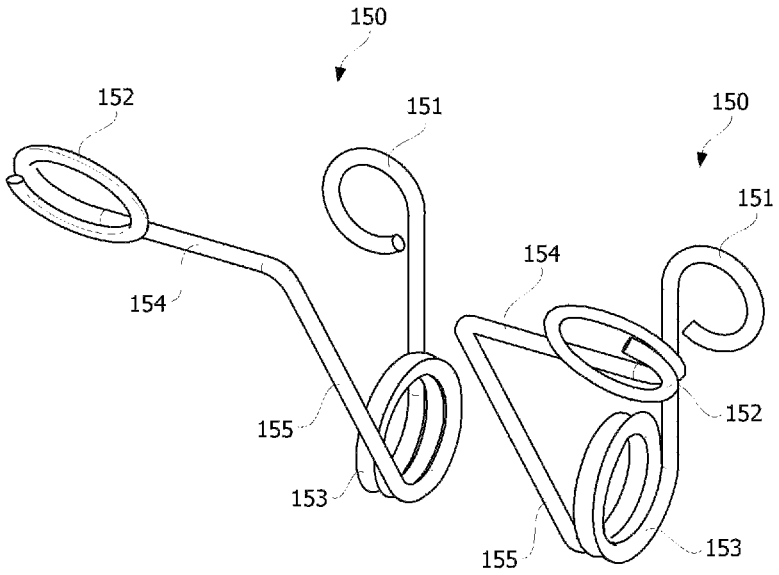
FIG. 3 is a perspective view of an elastic switch according to the preferred embodiment.

FIG. 1 is a conceptual view of a straight type lamp according to a preferred embodiment of the present invention, FIG. 2 is an exploded perspective view of a socket according to the preferred embodiment of the present invention, and FIG. 3 is a perspective view of an elastic switch according to the preferred embodiment.

Referring to FIGS. 1 and 2, the straight type lamp according to the preferred embodiment of the present invention includes a lamp body 200, and a pair of sockets 100 forcedly fit to both ends of the lamp body 200. The sockets 100 are respectively connected to a fluorescent light fixture (which includes electric outlets to which terminal pins are respectively inserted) buried in the ceiling of a building so as to supply electricity to the lamp body 200.

In this invention, the straight type lamp may be defined as a lamp which has a predetermined length and attached to the ceiling of the building in order to serve as a lighting lamp, and the conventional LED fluorescent lamps as well as the conventional mercury fluorescent lamps all belong to the present invention. Hereinafter, an LED fluorescent lamp will be described as an example.

The lamp body 200 includes: a printed circuit board 220 on which a plurality of light emitting elements 210 are arranged; a light transmission member 230 and 240 in which the printed circuit board 220 is accommodated; and a power supply part for supplying electricity to the light emitting elements 210.

The plural light emitting elements 210 may be LEDs or OLEDs, and are mounted on the printed circuit board 220. The printed circuit board 220 which is divided into multiple parts may be mounted according to the length of the straight type lamp.

The light transmission member 230 and 240 is formed in an approximately cylindrical shape, and emits light emitted from the light emitting elements 210. The light transmission member 230 and 240 includes a first cover 230 and a second cover 240, and is formed in the cylindrical shape by combination of the first cover 230 and the second cover 240. The second cover 240 has screw grooves 241 to which ends of third bolts 190 are joined.

The light transmission member 230 and 240 may have a diffusion pattern (not shown) formed along the circumferential surface thereof so as to enhance the degree of uniformity and to prevent bright point defects from being recognized from the outside. Besides the above, all general structures of lamps using LEDs as light sources may be applied to the straight type lamp according to the preferred embodiment of the present invention.

The sockets 100 are respectively joined to both ends of the lamp body 200 by the third bolt 190 so as to supply external electricity to the light emitting elements 210. Concretely, the socket 100 includes: a socket housing 110 and 120; a pair of terminal pins 130 respectively protruding to one side of the socket housing 110 and 120; a pair of power connection terminals 170 respectively exposed to the other side of the socket housing 110 and 120; a push button 140 protruding to one side of the socket housing 110 and 120; and a pair of elastic switches 150 respectively electrically connecting the terminal pins 130 and the power connection terminals 170 with each other. All or one of the both sockets may have such a socket structure.

The socket housing 110 and 120 includes: a first socket housing 110 having a button opening portion 115 from which the push button 140 protrudes; and a second socket housing 120 having a pair of second through holes 122 to which the power connection terminals 170 are inserted. The elastic switches 150 are arranged inside a receiving space 116 formed between the first socket housing 110 and the second socket housing 120.

The first socket housing 110 has the internal receiving space 116 in which portions of the terminal pins 130 are respectively accommodated and is screw-coupled with the second socket housing 120 by the third bolts 190 so as to seal the internal receiving space 116. The first socket housing 110 includes first and second joining grooves 112 and 113 and screw holes 111 screw-coupled with the second socket housing 120. The internal receiving space 116 is as wide as the push button 140 is movable backward.

The second socket housing 120 includes first and second joining protrusions 124 and 125 joined with the first socket housing 110, and screw holes 123 screw-coupled with the first socket housing 110. The second socket housing 120 further includes a receiving recess 121 for receiving the elastic switches 150 therein, and second through holes 122 formed in the bottom surface of the receiving recess 121 for respectively inserting the power connection terminals thereinto.

Each of the terminal pins 130 includes: an input terminal 131 protruding to the outside of the first socket housing 110 and being connected with an external power supply; and an output terminal 132 arranged inside the internal receiving space 116 of the first socket housing 110. The output terminal 132 of the terminal pin 130 has an insulating member 133 formed at a position which gets in contact with the elastic switch 150. The insulating member 133 is not limited in kinds of materials if it is made of any material which provides electrical insulation. As an example, the insulating member 133 may be made of a plastic material which is the same as the socket housing.

The power connection terminals 170 are inserted and fixed into the second through holes 122 of the second socket housing 120. The power connection terminals 170 are not limited in kinds of materials if they are made of any material which provides electrical connection. Each of the power connection terminals 170 may have a screw thread which is formed on the inner circumferential surface and is screw-coupled with the first bolt 160. The power connection terminals 170 may be inserted and fixed into the second through holes 122 of the second socket housing 120 by injection molding.

The push button 140 protrudes to the button opening portion 115 of the first socket housing 110. When the straight type lamp is installed to the fluorescent light fixture, the push button 140 is pressed and electrically connects the elastic switches 150 with the terminal pins 130. Therefore, when the push button 140 does not work, because electric current does not flow to the straight lamp, a user can replace the lamp in safety. The push button 140 includes: a protrusion 141; a guide protrusion 142 guided to the second joining groove 112 disposed in the first socket housing 110; and a pressing portion 143 for pressing the elastic switches 150.

Referring to FIGS. 2 and 3, each of the elastic switches 150 includes: a first connection terminal 151 electrically connected to the power connection terminal 170; a second connection terminal 152 getting in contact with the output terminal 132 of the terminal pin 130; an elastic portion 153 formed between the first connection terminal 151 and the second connection terminal 152 for providing elasticity; and an elasticity transferring portion 155 formed between the second connection terminal 152 and the elastic portion 153 and getting in contact with the push button 140. The connection portion 154 is perpendicularly bent in an extension direction of the elasticity transferring portion 155 and is connected with the second connection terminal 152.

The first connection terminal 151 of the elasticity switch 150 is electrically connected and fixed to the power connection terminal 170 by the first bolt 160. The first connection terminal 151 is bent in a ring shape and is restricted to the first bolt 160. The second connection terminal 152 of the elasticity switch 150 is bent in a ring shape and forcedly fit to the output terminal 132 of the terminal pin 130.

Figure 4:
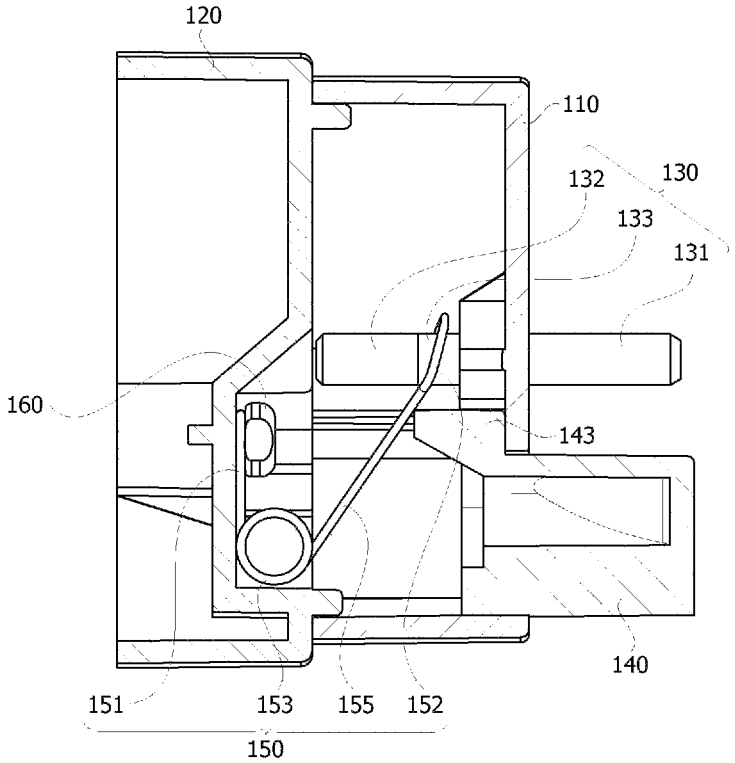
FIG. 4 is a sectional view of the socket according to the preferred embodiment.
Figure 5:
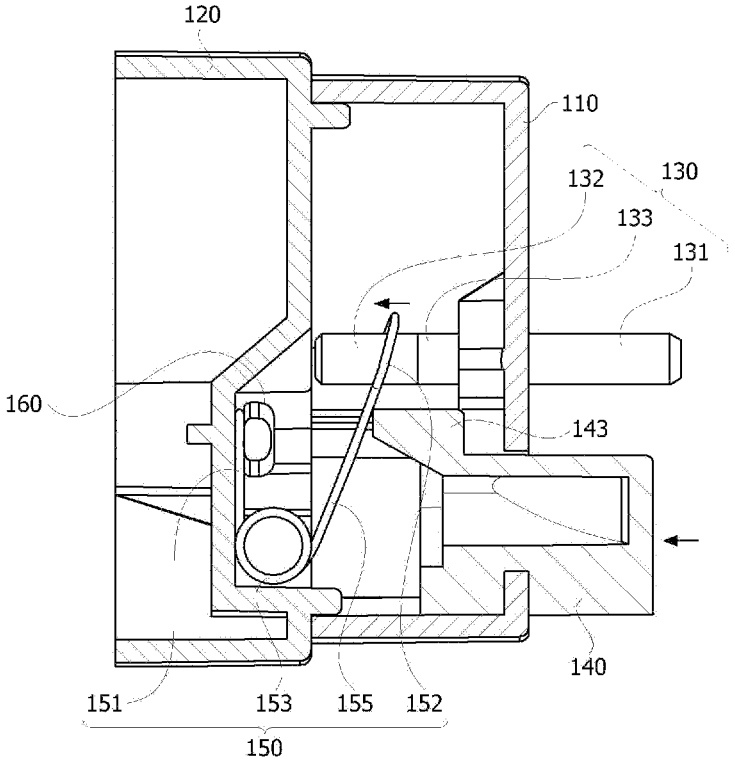
FIG. 5 is a view for explaining a state where the elastic switch and a terminal pin are electrically connected with each other according to the preferred embodiment.
Figure 6:
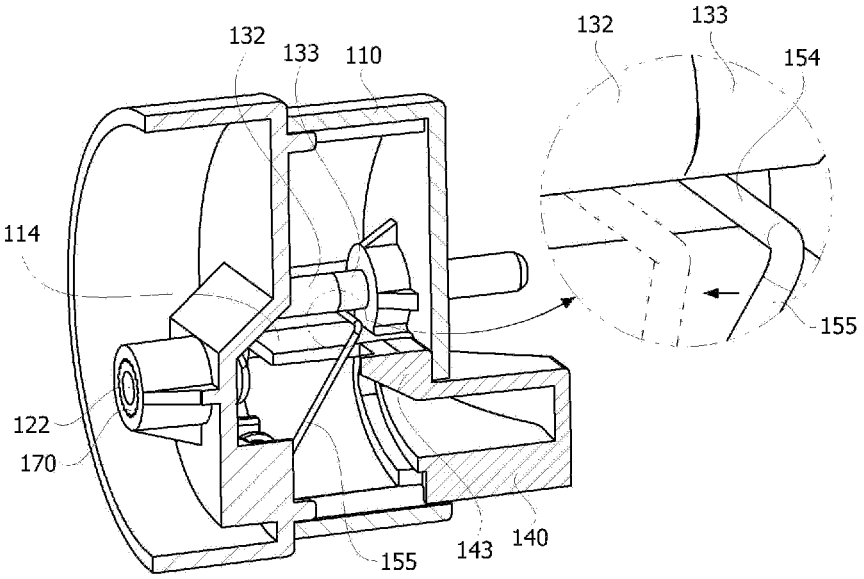
FIG. 6 is a view of a modification of the elastic switch according to the preferred embodiment.

FIG. 4 is a sectional view of the socket according to the preferred embodiment, FIG. 5 is a view for explaining a state where the elastic switch and a terminal pin are electrically connected with each other according to the preferred embodiment, and FIG. 6 is a view of a modification of the elastic switch according to the preferred embodiment.

Referring to FIG. 4, the second connection terminal 152 of the elasticity switch 150 is forcedly fit and arranged to the output terminal 132 of the terminal pin 130. However, as described above, because the output terminal 132 of the terminal pin 130 has the insulating member 133 formed at the position which gets in contact with the elasticity switch 150, the second connection terminal 152 of the elasticity switch 150 is electrically disconnected from the output terminal 132. In this instance, the insulating member 133 may extend from the inner wall of the first socket housing 110.

Referring to FIG. 5, when the push button 140 moves backwardly (in the direction of the second socket housing 120) by pressurization, the pressing portion 143 of the push button 140 presses the elasticity transferring portion 155 of the elasticity switch 150. Therefore, the second connection terminal 152 connected with the elasticity transferring portion 155 moves backwardly in the state where it is forcedly fit to the output terminal 132, and thus, is electrically connected with the output terminal 132. Therefore, electric power applied to the input terminal 131 of the terminal pin 130 is transmitted to the lamp body 200 through the output terminal 132, the elasticity switch 150 and the power connection terminal 170.

In this instance, when the lamp is separated from the fluorescent light fixture by replacement of the lamp, as shown in FIG. 4, the push button 140 returns to its original position by elasticity of the elasticity switch 150, and the second connection terminal 152 moves to the position where the insulating member 133 of the output terminal 132 is formed so as to be electrically disconnected.

Referring to FIG. 6, when the push button 140 moves backwardly, the elasticity transferring portion 155 is guided by the guide member 114 protrudingly formed on the first socket housing 110 so as to be moved backward. Moreover, the elasticity switch 150 may be arranged in a state where it is not fit to the output terminal 132 but is in contact with the terminal pin. That is, the second connection terminal is omitted, and the connection portion 154 is electrically connected with the output terminal 132. In this instance, the connection portion 154 is electrically connected with the output terminal 132 while being moved backwardly by the push button 140.

Figure 7:
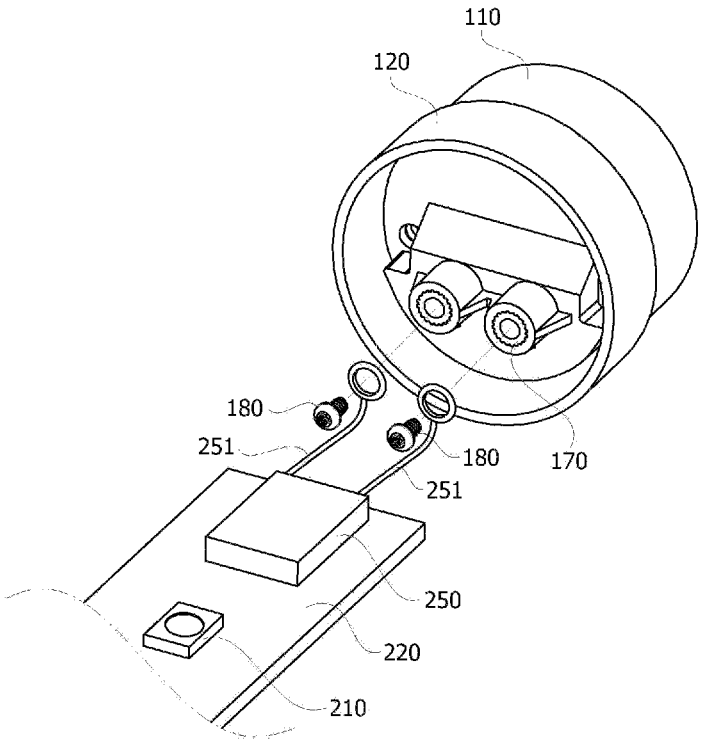
FIG. 7 is a conceptual view showing a state where the socket and a lamp body are electrically connected with each other according to the preferred embodiment.

FIG. 7 is a conceptual view showing a state where the socket and the lamp body 200 are electrically connected with each other according to the preferred embodiment.

Referring to FIG. 7, a wire 251 is connected to the other end of the power connection terminal 170 exposed to the rear surface of the second socket housing 120. A second bolt 180 fastens the wire 251 to the power connection terminal 170. A power supply part 250 converts AC power into DC power and applies the DC power to the light emitting elements 210.

The power supply part 250 may be one of an AC-DC converter and a SMPS (Switching Mode Power Supply). The SMPS includes: a noise filter for removing noise contained in a commercial AC power supply; a rectifying part for rectifying the noise filter; and a switching part for switching electricity smoothed through the rectifying part by the pulse wide method. The power supply part 250 may be mounted on the printed circuit board 220, but the present invention is not limited to the above.

What is claimed is:

1. A straight type lamp comprising:

a lamp body; and a pair of sockets fit to both ends of the lamp body, wherein at least one of the sockets comprises:

a socket housing;

a plurality of terminal pins, each of which includes an input terminal protruding to one side of the socket housing and an output terminal disposed inside the socket housing;

a push button protruding to the one side of the socket housing;

a plurality of elasticity switches, each of which is electrically connected with a respective one of the terminal pins when the push button moves backwardly and which is electrically disconnected from the respective one of the terminal pins when the push button returns to an original position of the push button; and a plurality of power connection terminals respectively arranged at an other side of the socket housing and electrically connected with first connection terminals of the elasticity switches, wherein each of the elasticity switches comprises:

one of the first connection terminals which is electrically connected to a corresponding one of the power connection terminals;

a second connection terminal getting in contact with a corresponding one of the output terminals of the terminal pins;

an elastic portion formed between the one of the first connection terminals and the second connection terminal, the elastic portion for providing elasticity; and an elasticity transferring portion formed between the second connection terminal and the elastic portion, the elasticity transferring portion getting in contact with the push button.

2. The straight type lamp according to claim 1, wherein the output terminal of each of the terminal pins comprises an insulating member formed at a position which is in contact with the second connection terminal of the corresponding one of the elasticity switches which gets in contact with the output terminal, and the second connection terminal of the corresponding one of elasticity switches moves backwardly to the rear of the insulating member so as to be electrically connected with the output terminal when the push button moves backwardly.

3. The straight type lamp according to claim 1, wherein the socket housing comprises:

a first socket housing having a button opening portion from which the push button protrudes; and a second socket housing having a plurality of second through holes to which the power connection terminals are inserted.

4. The straight type lamp according to claim 1, further comprising:

a first bolt adapted to electrically connect a corresponding one of the first connection terminals of the elasticity switches to one side of the corresponding one of the power connection terminals; and a second bolt adapted to electrically connect a wire to another side of the corresponding one of the power connection terminals which is adapted to be electrically connected to the corresponding one of the first connection terminals by the first bolt.

5. The straight type lamp according to claim 1, wherein the lamp body comprises:

a printed circuit board on which a plurality of light emitting elements are arranged;

a light transmission member in which the printed circuit board is accommodated; and a power supply part connected with the power connection terminals so as to supply electricity to the light emitting elements.

6. The straight type lamp according to claim 2, wherein each of the second connection terminals of the elasticity switches is formed in a ring shape and fit to the corresponding output terminal.

7. The straight type lamp according to claim 3, further comprising:

a third bolt penetrating the first socket housing and the second socket housing and being joined to the lamp body.

* * * * *